US010293999B2

(12) United States Patent
Warren et al.

(10) Patent No.: US 10,293,999 B2
(45) Date of Patent: May 21, 2019

(54) TRANSPORTATION COLLAR FOR SHIPPING A CONTAINER

(71) Applicant: Behr Process Corporation, Santa Ana, CA (US)

(72) Inventors: Gregory James Warren, Costa Mesa, CA (US); Terry L. Berrier, Cypress, CA (US); Robert Edward Herndon, Paramount, CA (US); Roy Crogan, Orange, CA (US); Gregory Charles Brod, Santa Ana, CA (US)

(73) Assignee: Behr Process Corporation, Santa Ana, CA (US)

( * ) Notice: Subject to any disclaimer, the term of this patent is extended or adjusted under 35 U.S.C. 154(b) by 176 days.

(21) Appl. No.: 15/346,038

(22) Filed: Nov. 8, 2016

(65) Prior Publication Data

US 2018/0127181 A1 May 10, 2018

(51) Int. Cl.

| | |
|---|---|
| ***B65D 81/02*** | (2006.01) |
| ***B65D 85/30*** | (2006.01) |
| ***B65D 71/70*** | (2006.01) |
| ***B44D 3/12*** | (2006.01) |

(52) U.S. Cl.

CPC ..... *B65D 71/70* (2013.01); *B44D 3/127* (2013.01)

(58) Field of Classification Search

CPC ..... B65D 71/70; B65D 81/02; B44D 3/127; B44D 3/128; B44D 3/14; B44D 3/30

USPC ..... 206/589, 1.9, 816, 504, 508, 139, 1.8, 206/446, 821, 503, 509; 220/213, 378, 220/578, 315, 319, 495.02

See application file for complete search history.

(56) References Cited

U.S. PATENT DOCUMENTS

| | | | | |
|---|---|---|---|---|
| 3,469,735 | A * | 9/1969 | Burt | B65D 25/50 220/698 |
| 3,688,942 | A | 9/1972 | Mitchell et al. | |
| 3,693,829 | A | 9/1972 | Price | |
| 3,913,785 | A | 10/1975 | Pattershall | |
| 3,967,731 | A | 7/1976 | Boduch | |
| 3,977,563 | A | 8/1976 | Holt | |
| 4,676,392 | A | 6/1987 | Giggard et al. | |
| 4,932,554 | A | 6/1990 | Smith et al. | |
| 5,156,273 | A * | 10/1992 | Mortensen | B29C 65/08 156/321 |
| 5,161,689 | A | 11/1992 | Balson | |
| 5,193,705 | A | 3/1993 | McCallum et al. | |
| 5,232,120 | A | 8/1993 | Dunken et al. | |
| 5,803,298 | A | 9/1998 | Hausmann | |
| 5,915,557 | A * | 6/1999 | Levine | B65D 21/0224 206/509 |
| 5,967,363 | A * | 10/1999 | Allen | B44D 3/128 220/701 |

(Continued)

*Primary Examiner* — Rafael A Ortiz
(74) *Attorney, Agent, or Firm* — Reising Ethington, P.C.

(57) ABSTRACT

A transportation collar that includes a ring having a central longitudinal axis and including: a base wall extending transversely and radially inwardly with respect to the axis, and an annular skirt extending in a first axial direction axially away from the base wall; and a peripheral impact barrier extending radially outwardly from the ring adapted to position both the transportation collar and a container carried by the collar relative to one or more additional adjacent transportation collars and one or more additional corresponding containers, wherein the peripheral impact barrier comprises a flange wall extending transversely with respect to the axis.

17 Claims, 5 Drawing Sheets

(56) References Cited

U.S. PATENT DOCUMENTS

| | | | | |
|---|---|---|---|---|
| 6,142,330 | A * | 11/2000 | Sacks | B65D 45/30 206/503 |
| 6,612,439 | B1 | 9/2003 | Levine | |
| 7,617,946 | B2 | 11/2009 | Loerop et al. | |
| 8,695,846 | B2 | 4/2014 | Letica et al. | |
| 8,827,096 | B1 | 9/2014 | Macpherson | |
| 9,109,316 | B1 | 8/2015 | Thomson | |
| 9,174,776 | B1 * | 11/2015 | DeTolla | B44D 3/127 |
| 2004/0195138 | A1 | 10/2004 | van Holdt, Jr. | |
| 2007/0000804 | A1 | 1/2007 | Wylie | |
| 2008/0060965 | A1 | 3/2008 | Stevens et al. | |
| 2011/0036843 | A1 | 2/2011 | Letica et al. | |
| 2012/0312820 | A1 | 12/2012 | Cadiente | |
| 2013/0213841 | A1 | 8/2013 | Ward | |
| 2016/0016700 | A1 | 1/2016 | Stevens | |

* cited by examiner

TRANSPORTATION COLLAR FOR SHIPPING A CONTAINER

TECHNICAL FIELD

This disclosure relates generally to a transportation collar for shipping a container.

BACKGROUND

Packages, for example, paint packages, can be somewhat difficult to transport or ship. During shipment, the package may become dented or otherwise damaged. Further, as a result of handling and/or extreme air pressure differentials, a lid of the package may become dislodged from a respective container resulting in spoilage of the contents thereof.

SUMMARY OF THE DISCLOSURE

One illustrative embodiment of a transportation collar includes a ring having a central longitudinal axis and including: a base wall extending transversely and radially inwardly with respect to the axis, and an annular skirt extending in a first axial direction axially away from the base wall; and a peripheral impact barrier extending radially outwardly from the ring adapted to position both the transportation collar and a container carried by the collar relative to one or more additional adjacent transportation collars and one or more additional corresponding containers, wherein the peripheral impact barrier comprises a flange wall extending transversely with respect to the axis.

In accordance with another illustrative embodiment, there is provided a transportation collar. The collar includes: a ring having a central longitudinal axis and including: a base wall extending transversely with respect to the axis, that includes: a planar portion extending radially inwardly with respect to the axis, and a stepped portion extending radially inwardly from the planar portion and extending at least partially in a first axial direction; a first annular skirt extending in the first axial direction axially away from the base wall, and a second annular skirt extending in a second, opposite axial direction away from the base wall; and a peripheral impact barrier extending radially outwardly from the ring.

In accordance with another illustrative embodiment, there is provided a transportation collar. The collar includes: a ring having a central longitudinal axis and including a base wall extending transversely with respect to the axis and including a planar portion and a stepped portion extending radially inwardly from the planar portion and in a first axial direction axially away from the base wall, a first annular skirt extending in the first axial direction axially away from the base wall, including a first radially inwardly extending bead, and having a first inner diameter, and a second annular skirt extending in a second direction axially away from the base wall, including a second radially inwardly extending bead, and having a second inner diameter larger than the first inner diameter of the first annular skirt; a first side with a first contour corresponding to a first package type and at least partially established by a first side of the stepped portion of the base wall and the first annular skirt; and a second side with a second contour corresponding to a second package type and at least partially established by a second side of the stepped portion of the base wall and the second annular skirt.

DETAILED DESCRIPTION

Figure 1:
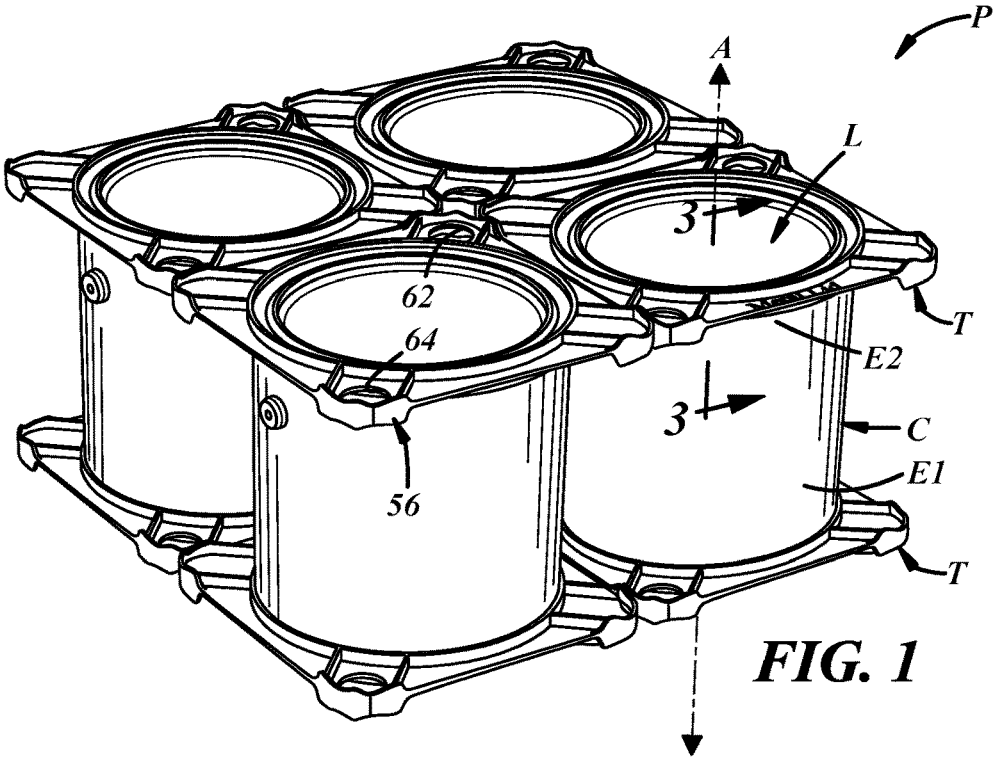
FIG. 1 is a perspective view of a plurality of packaging assemblies according to an illustrative embodiment.

In general, a novel package assembly P is disclosed that includes a container C, a lid or closure L for the container C, and one or more transportation collars T; the transportation collar(s) facilitate shipping the container C and also retaining the lid L thereon during shipment. An illustrative package assembly P is shown in FIG. 1 having two collars T attached to each container C and located at opposite ends thereof. As will become apparent from the description below, using the collars T to space the illustrative four-pack of package assemblies P from one another during shipping may inhibit damage to the containers C thereof.

According to another novel aspect of the disclosure, each transportation collar T may be reversible and may be used with different types of containers and/or lids. Thus for example, a single transportation collar T may be used by a paint manufacturer that packages and ships different types of paint cans and/or lids. In addition, each collar T in the pair may be identical to the other—further promoting so-called component commonality at the paint manufacturer.

While the apparatus described herein includes an illustrative embodiment of a paint package including a paint can and a corresponding lid, it will be appreciated as the description proceeds that the apparatus may be useful in many different applications and may be implemented in many other embodiments. Also, as used herein, it will be understood that the term "paint" refers not only to paint applications, but also to stain, varnish, and other applications. In other words, as used herein, the term "paint" broadly includes paint, stain, varnish, and any other similar products.

In FIG. 1, the four-pack of packaging assemblies P are arranged adjacently in a rectangular pattern. With respect to each assembly P, one transportation collar T is coupled to a closed bottom end E1 of the container C, and another transportation collar T is coupled to an open top end E2 of the container C and its corresponding lid L (and adapted to seal the contents therein). For purposes of illustration only, the terms top, bottom, above, below, upper, lower, etc. are used for description and orientation purposes only and are not intended to be limiting.

Figure 3:
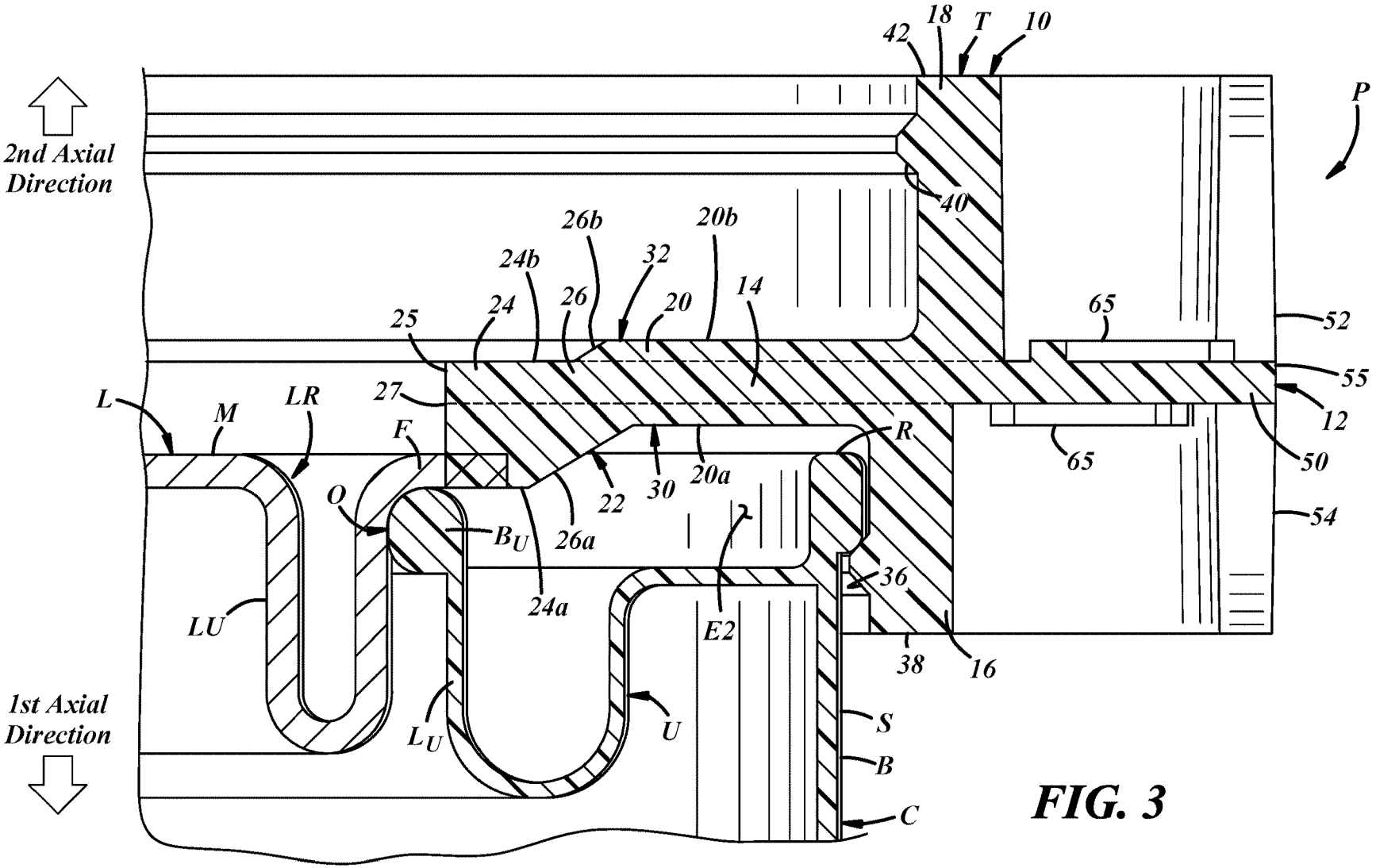
FIG. 3 is a partial sectional view of one of the packaging assemblies shown in FIG. 1, along section line 3.
Figure 4:
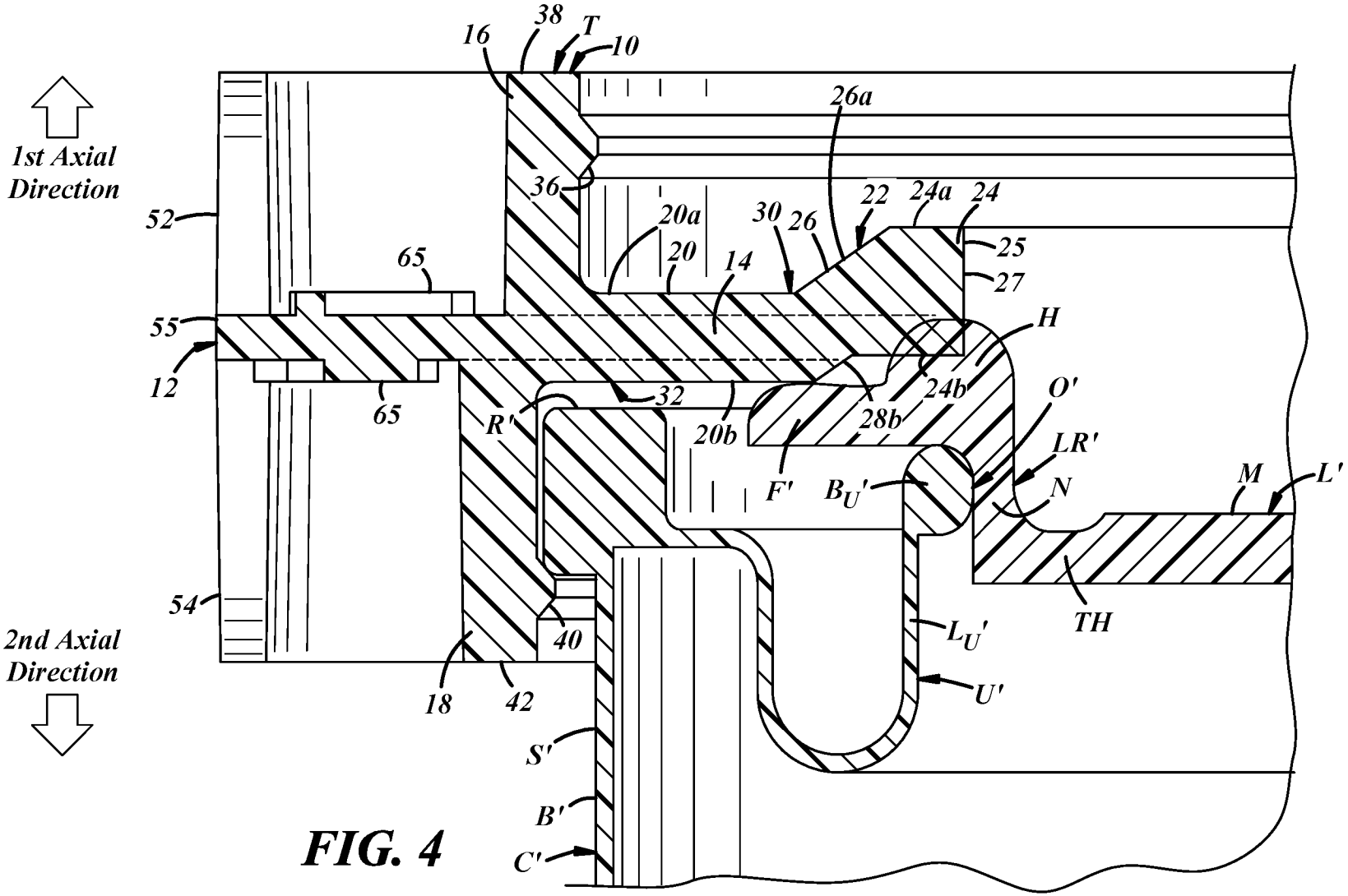
FIG. 4 is a partial sectional view of the transportation collar shown in FIG. 2 (inverted) and coupled to a different type of container than that shown in FIG. 1.

As discussed above, the transportation collars T may be reversible or usable with different types of containers or container/lid configurations. FIGS. 1 and 3 show one illustrative configuration, whereas FIG. 4 shows another illustrative configuration. Each will be discussed in turn.

In FIG. 3, the container C may include a body portion B having a closed bottom end (not shown), an open top end E2, a radially outer surface S, and an annular container rim R at the open top end E2 and including a U-shaped channel U for coupling the container C to the corresponding lid L. The channel U includes a bead $B_U$ at a radially inboard leg $L_U$, and the bead defines an opening O of the container C.

In FIG. 3, the lid L may include a central portion or base wall M that may be planar, and an annular lid rim LR disposed radially outwardly of the central portion M and including a resilient U-shaped channel or wall LU that extends radially outwardly and downwardly from the central portion M and that is adapted for an interference fit within opening O against bead $B_U$. In at least one embodiment, the lid rim LR includes a radially outwardly extending flange F that extends radially outwardly from the channel LU (shown in an interference fit with the transportation collar T in FIG. 3). According to one embodiment, the lid L may be comprised of metal; however, other materials or combinations of materials are also possible.

FIG. 4 illustrates an inverted or flipped-over transportation collar T and another container C' that has at least some similar features as container C; thus, like reference numerals indicate like or identical features and/or functions. In at least one embodiment, rim R' may be larger or wider than rim R, a width and/or depth of the channel U' may be different than the width and/or depth of channel U, the shape and/or size of bead $B_U'$ may be different than bead $B_U$, the spacing between rim R' and bead $B_U'$ may be smaller or narrower than the spacing between rim R and bead $B_U$, etc. Other differences may be exist as well; these are merely examples.

Lid L' may also differ from lid L; e.g., according to one embodiment, lid L' may be comprised of plastic. (Again however, other materials or combinations of materials are possible.) For example, in FIG. 4, the annular lid rim LR' of lid L' may not have a U-shaped channel. Instead in at least one embodiment, the lid rim LR' may have a resilient thinner portion TH located radially outwardly of the central portion M'. Further, a neck N may extend in a first axial direction (e.g., upwardly in FIG. 4) from the thinner portion TH to a bulbous head H, and a flange F' may extend radially outwardly from the head H. In this embodiment, when the lid L' is sealed to container C', leg LU' resiliently may flex radially outwardly in an interference fit with the neck N while the thinner portion TH resiliently may flex so that the head H pivots thereabout.

Figure 2:
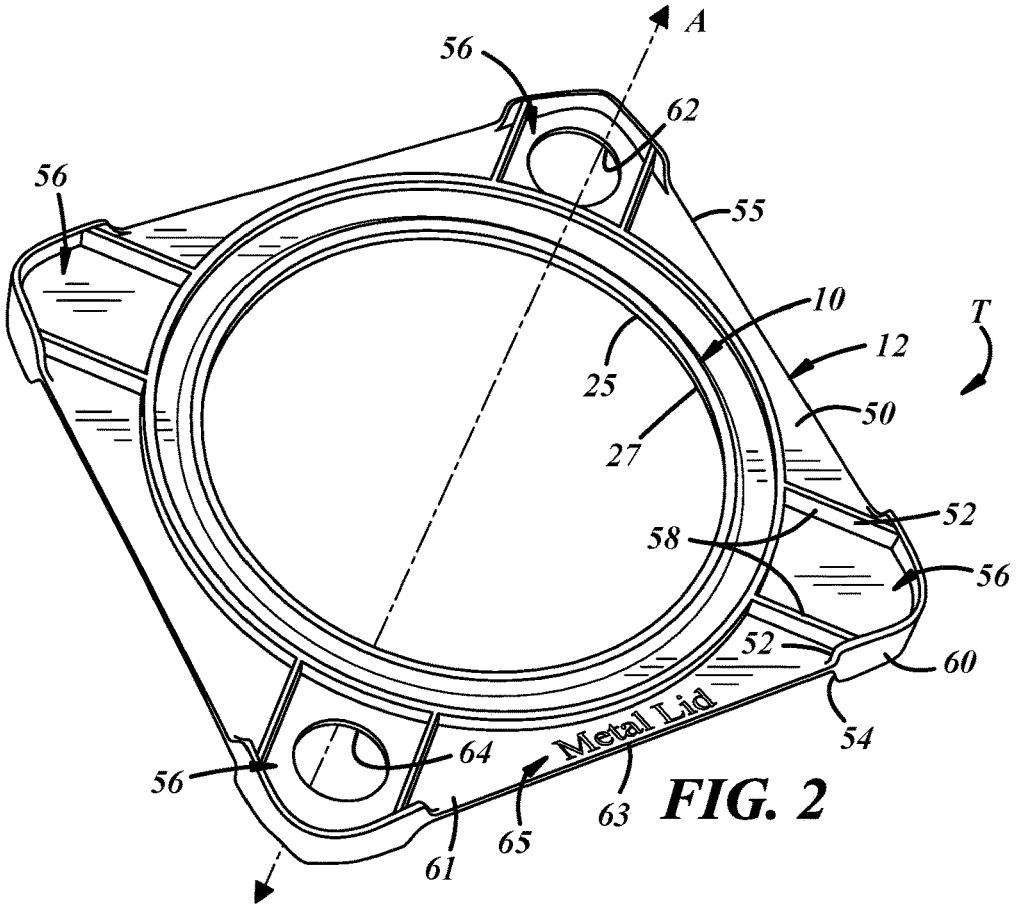
FIG. 2 is a perspective view of an illustrative embodiment of a transportation collar of one of the plurality of packaging assemblies shown in FIG. 1.

FIGS. 2-4 illustrate various features of the reversible transportation collar T according to at least one embodiment. In general, the collar T includes a ring 10 (surrounding a central longitudinal axis A) and a peripheral impact or crush zone barrier 12 which together may be formed in a single integral piece of metal, plastic, hybrid metal-plastic, or any other suitable material(s). As shown in FIG. 3, the ring 10 may have a base wall 14, a first annular skirt 16 extending in the first axial direction (e.g., downward in FIG. 3), and a second annular skirt 18 extending in a second and opposite axial direction (e.g., upward in FIG. 3).

The base wall 14 includes a planar portion 20 extending radially inwardly from the first annular skirt 16 with first and second axially opposite surfaces 20*a*, 20*b* and a stepped portion 22 that extends radially inwardly from the planar portion 20 and includes an axial component (e.g., which also partially extends in the first axial direction). More particularly, in the illustrated embodiment, the stepped portion 22 includes a second planar portion 24 which is parallel to the first planar portion 20 and has first and second axially opposite surfaces 24*a*, 24*b*, and a connecting portion 26 which extends both radially inwardly and axially (in the first axial direction) thereby coupling both planar portions 20, 24 and has first and second axially and radially opposite surfaces 26*a*, 26*b*. And a radially inboard end surface 25 of the second planar portion 24 extends axially between surfaces 24*a*, 24*b* (e.g., and surface 25 may define a through hole opening 27 of the transportation collar T). Thus, stepped portion 22 can be stepped in the first axial direction along with skirt 16 (e.g., surface 24*b* may be axially offset with respect to surface 20*b*). This is merely one example however; other implementations also exist. For example, the stepped portion 22 could have a different angular contour (e.g., it could be curved and/or curved and angular). It should be appreciated that at least a portion of a first side 30 of the collar T—i.e., a contour of the first side 30—may correspond to the features of lid L. In FIG. 3, lid L (more specifically, flange F) is shown in an interference fit with the contour of the first side 30 (interfering with the stepped portion 22, more specifically, surface 24*a*).

Conversely, it should be appreciated that at least a portion of a second and opposite side 32 of the collar T—i.e., a contour of the second side 32—may correspond to features of lid L' (as shown in FIG. 4). Likewise, lid L' (more specifically, head H) is shown in an interference fit with the contour of the second side 32 (again, interfering with the stepped portion 22).

As shown in FIG. 3, the downwardly extending first annular skirt 16 may be positioned radially inboard with respect to the second annular skirt and may have a retaining bead 36 spaced between an axial end 38 of the skirt and the base wall 14. The bead 36 may extend radially inwardly from the skirt 16 and may be adapted for a snap-fit or interference fit with the rim R of container C. When the rim R is retained by the bead 36, the flange F also is urged in the first axial direction by the stepped portion 22 (more particularly, the second planar portion 24 and, more specifically, surface 24*a*). Thus, the flange F and/or the base wall 14 resiliently may deform to achieve the illustrated interference fit therebetween. According to at least one embodiment, the base wall 14 resiliently flexes in the second axial direction in a region of the first planar portion 20. Accordingly during shipping, the container C can be positioned and retained with respect to the transportation collar T, and the lid L can be positioned and retained with respect to the container C.

In FIG. 4, the transportation collar T is illustrated in a reversed position (e.g., flipped over so that the second side 32 engages container C' and lid L'). Here, the second annular skirt 18 may have a retaining bead 40 spaced between an axial end 42 of the skirt and the base wall 14—and the bead 40 may extend radially inwardly from the skirt 18 and may be adapted for a snap-fit or interference fit with the rim R' of container C'. When the rim R' is retained by the bead 40, the flange F' and/or head H also is urged in the second axial direction by the stepped portion 22 (more particularly, the second planar portion 24 (e.g., surface 24*b*)). Thus, at least one of the flange F', the head H, or the base wall 14 resiliently may deform to achieve the illustrated interference fit therebetween. According to at least one embodiment, the base wall 14 resiliently flexes in the first axial direction in a region of the first planar portion 20. Thus, similar to the description above, during shipping, container C' can be positioned and retained with respect to the transportation collar T, and the lid L' can be positioned and retained with respect to the container C'.

While not shown in the illustrations, it should be appreciated that each of the closed bottom ends E1 of containers C may have a rim (e.g., similar to rim R). In this manner, depending on the orientation of the collar T, the container and lid may be positioned and retained by the collar using bead 36 or 40.

Turning now to the peripheral impact barrier 12 (FIG. 3), the barrier may include a flange wall 50 that extends radially outwardly of the base wall 14 and one or more axially extending peripheral skirts 52, 54. For example, barrier 12 may include a radially outer periphery 55 that is non-circular with respect to the longitudinal axis A; as described below, this may enable the barrier 12 to be located against one or more straight interior surfaces of a shipping container. Flange wall 50 and/or impact barrier 12 may extend from base wall 14 in at least two circumferential locations (e.g., diametrically opposite one another), or in three or more locations (e.g., equidistantly spaced 120° apart), or as shown circumferentially extending around rim 10.

As best shown in FIG. 2, the flange wall 50 may be generally rectangular (e.g., square) and sized so that the ring 10 is enclosed within the flange 50 on all sides. Thus, impact barrier 12 may be of rectangular shape in top view (e.g., square-like shape). The embodiment of FIG. 2 includes a first skirt 54 extending in the first axial direction and a second skirt 52 extending in the second axial direction. The respective skirts 52, 54 may have an arrow-like shape and may be located at a corner region 56 of the flange wall 50. For example, each skirt 52, 54 may include two parallel and radially outwardly extending legs 58 and an squarely-shaped and filleted arrow head 60 pointing radially outwardly. In this manner, when packaging assemblies P are located adjacent one another (e.g., as in FIG. 1), the arrow heads 60 of the respective packaging assemblies P may be aligned squarely with another and thereafter placed in a box, shrink-wrapped together, or the like. It should be appreciated that a rectangular packaging arrangement may be useful in many shipping implementations (e.g., to maximize the volume of cargo shipped within a given space constraint). Furthermore, the peripheral impact barrier 12 may space respective containers C from one another thereby inhibiting damage of the containers C during shipment.

The flange wall 50 may have two pull tabs or through holes 62, 64 which are located within two of the opposite corner regions 56. Each hole 62, 64 may be sized for a human finger so that when a finger is located within the hole and the corner region 56 is drawn axially away from the container C, the collar T separates or disengages the container. Thus, according to one embodiment, special tools are not required to remove the collar T from the container and lid. The through holes 62, 64 can also be used as precision locators for handling and installation of the collar T in automation and/or tool-assisted environments.

In addition, as best shown in FIG. 2, one or both sides 61, 63 of the flange 50 may have include raised markings or other suitable indicia 65 (e.g., patent markings, instructions, etc.). For example, when the upper collar T is coupled to a container, the illustrative markings 65 (from a top view) may provide information regarding the type of lid for the container below. For example, the indicia may read "metal lid" or "plastic lid" or the like. This is merely one embodiment; other indicia implementations also exist.

FIGS. 5-8 illustrate other illustrative transportation collar embodiments T', T", T"', T"" which similarly do not require special tools. It should be appreciated that each embodiment may be reversible (e.g., sized to fit two differently shaped and/or sized containers); thus, each illustrated collar may have a base wall with a stepped portion and the first and/or second annular skirts. The peripheral impact barriers may differ however, as described below. Again, like reference numerals indicate like or identical features and/or functions.

Figure 5:
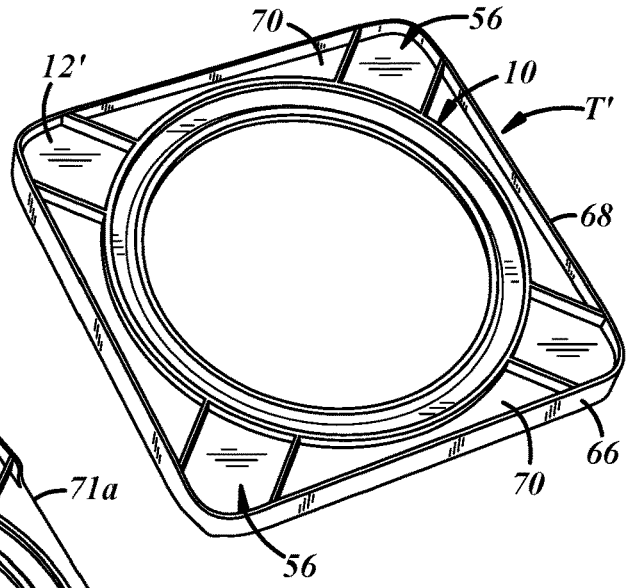
FIGS. 5-8 are illustrative alternative embodiments of the transportation collar shown in FIG. 2.

In FIG. 5, a radially outer periphery 66 of the barrier 12' of collar T' includes a rectangular, peripheral axially extending edge or rectangular outer periphery 68. Further, a portion of the flange wall may be absent. For example, between each of the corner regions 56—and between the ring 10 and edge 68—there may be an axially open gap 70. In addition, in this illustrated embodiment, there are no through holes 62, 64. It should be appreciated that one or more aspects of the embodiments shown in FIGS. 2 and 5-8 may be interchanged with one another in other suitable embodiments (thus, e.g., another embodiment may exist similar to that shown in FIG. 5 having one or more through holes or the like).

Figure 6:
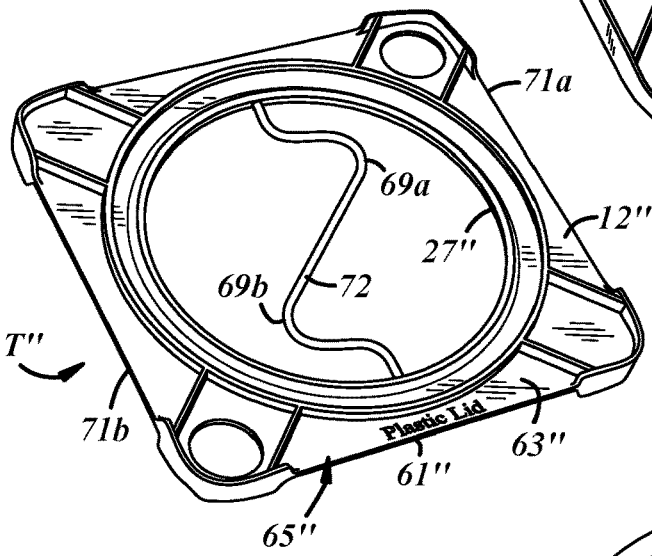

FIG. 6 illustrates a diametrically extending handle or grip 72 that may span the transportation collar T" so that the handle may be used to carry the container and lid (not shown). In the illustrated embodiment, the handle 72 generally may be planar and may span the opening 27" of collar T". Further, handle 72 may have a first bend or curved portion 69*a* extending toward a lateral side 71*a* of the barrier 12" and a second bend or curved portion 69*b* extending toward an opposite lateral side 71*b* (of barrier 12"). In some implementations, each handle 72 may be configured to bear up to 12 lbs of weight—e.g., which is typically sufficient to bear the weight of a filled paint package. Other features of collar T" may be similar to that shown and described above.

Figure 7:
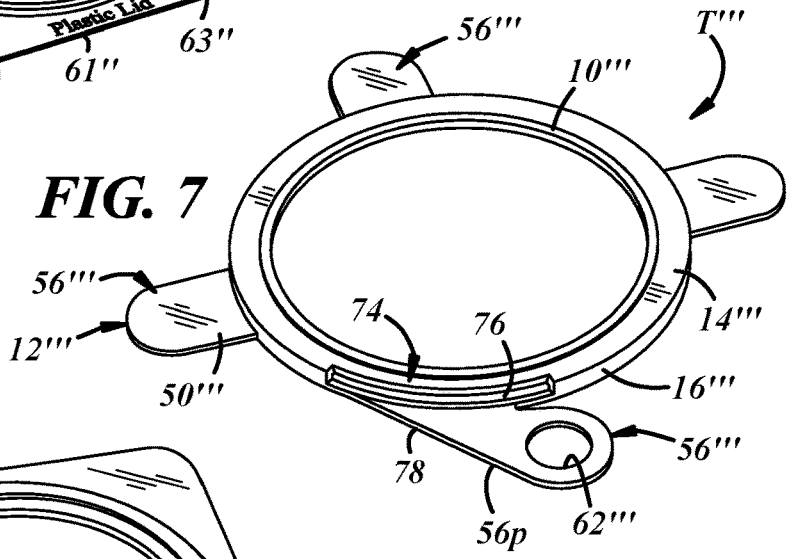

FIG. 7 illustrates collar T"' which has a peripheral impact barrier 12"' having a flange wall 50"' that may exclude an axially extending skirt. More particularly, the barrier 12"' includes four corner regions 56"' and at least one of the corner regions 56*p* includes a disengaging portion 74. The collar T"' may include a ring 10" that may have a base wall 14"', and an annular skirt 16"' extending away from the base wall 14". The disengaging portion 74 may be established by an elongated, circumferential slot 76 in a portion of a ring 10"' that corresponds to the particular corner region 56*p*. More particularly, the slot 76 may be provided in and between a portion of the base wall 14"' and a corresponding portion of the skirt 16"'. Accordingly, the disengaging portion 74 may include the corresponding portion of the skirt 16", as well as the corner region 56*p* which may include a tangential edge 78 and a pull tab or through hole 62"' (e.g., a finger-loop). Accordingly, when the corner region 56*p* is pulled in a radially outward direction and/or a circumferential direction, the disengaging portion 74 moves away from the rim R of the container (not shown), thereby facilitating release of the collar T"' from the container. Upon the corner region 56*p* being pulled in such a manner, the disengaging portion 74 may be configured to resiliently return to a state of rest once the collar T"' is released from the container, or may be configured to be torn or broken away from the rest of the ring 10"' during such pulling. Accordingly, in one embodiment, the collar T"' may be reusable and, in the other embodiment, the collar T"' may be discarded for recycling. In any case, the collar T"' is configured to allow for a tighter fit between the collar T"' and the container, yet still allow for easy removal of the collar T"' away from the container. In the illustrated embodiment, the corner region 56*p* may be configured to resiliently stretch, or rupture, the disengaging portion 74 along a circumferential direction. In another embodiment, the corner region 56*p* may be configured to rupture the disengaging portion 74 in an axial direction and/or a radial direction so as to split the ring 10"' from a circumferentially closed state to a circumferentially open state. Of course, this latter embodiment would destroy the collar T'", which could then be recycled instead of reused.

Figure 8:
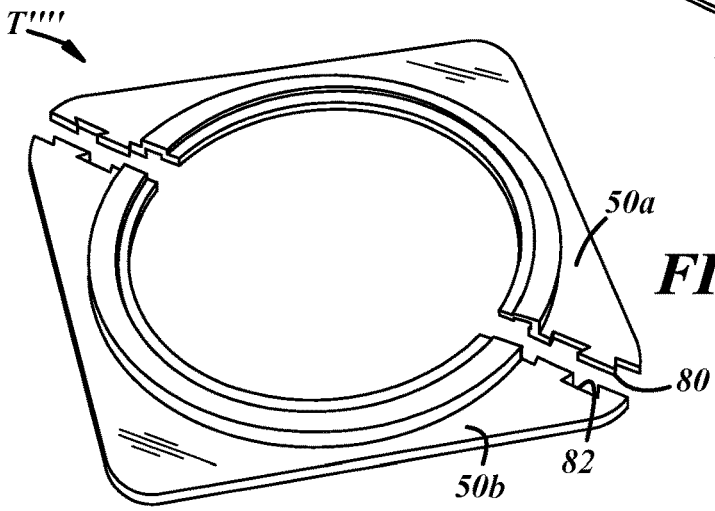

FIG. 8 illustrates a multi-piece transportation collar T"", wherein, when the collar T"" is assembled (or interlocked), it retains container C and lid L (not shown), and wherein, when collar T"" is disassembled (or not interlocked), it releases container C and lid L (not shown). A two-piece collar T"" is shown (e.g., two interlocking triangular-shaped pieces), wherein the respective flange walls 50*a*, 50*b* of each piece have corresponding dove-tailed tongue and groove features 80, 82.

The features of various implementing embodiments may be combined to form further embodiments of the invention.

Figure 9:
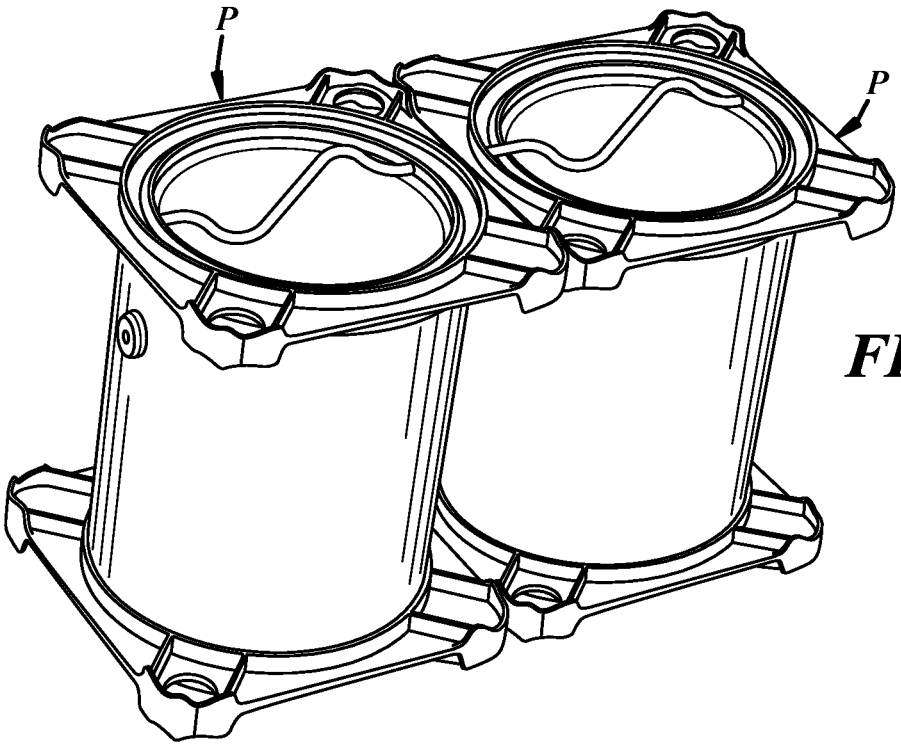
FIG. 9 is a perspective view of a different quantity of packaging assemblies than that shown in FIG. 1.
Figure 10:
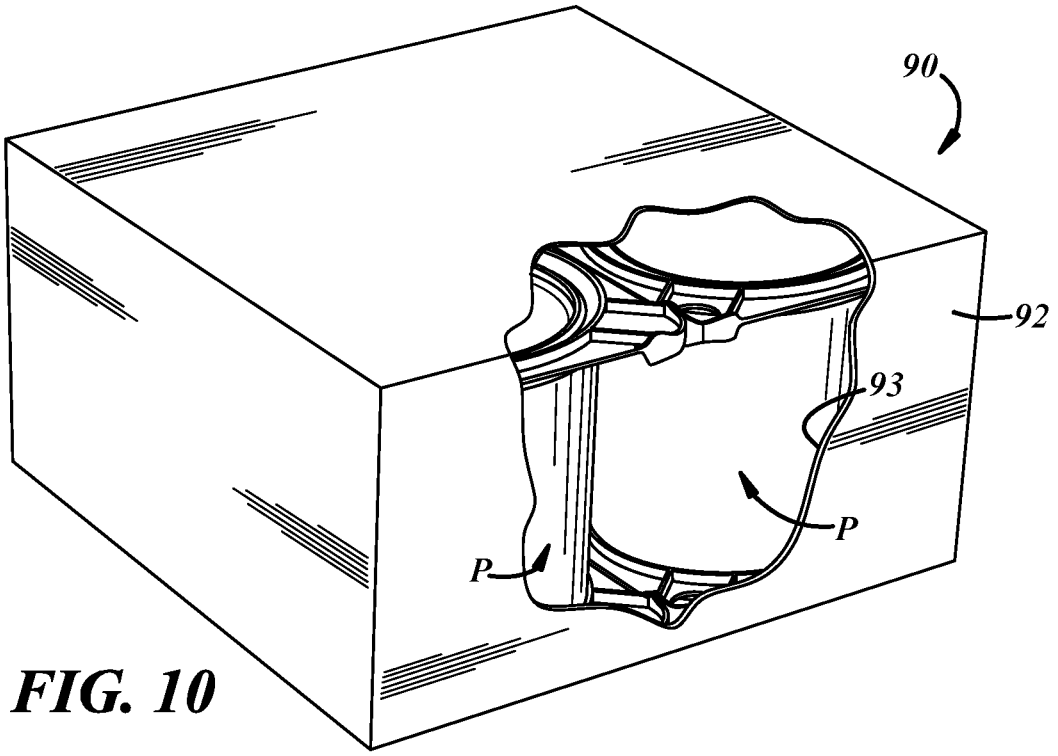
FIG. 10 is a perspective view of a parcel package that includes a parcel container and a plurality of packaging assemblies, wherein the container is partially cut-away to show the packaging assemblies therein.

In addition, for example, the packaging assemblies P may be arranged together in any suitable quantities. In the paint manufacturing industry, a four-container arrangement may be used depending on the sizes of the packages (as shown in FIG. 1); however, two-container arrangements as shown in FIG. 9 are typical. Other quantities also may be used. Regardless of the quantity, a parcel package 90 comprising the packaging assemblies P within a parcel container 92 (e.g., a box) may be used as shown in FIG. 10. During shipping, the peripheral impact barrier of the collar T may be located against one or more straight interior surfaces 93 of a shipping container 92 to minimize movement therein.

Thus, there has been described a novel packaging assembly. The assembly includes a container, a corresponding lid for the container, and at least one transportation collar. When the collar is located on the container, it may space the container from other like containers (e.g., during shipping) and further, it may resiliently urge the lid of the container to remain in a sealed position. The transportation collar may be configured so that it may be reversed or used on two different sides, each side having a different contour. In this manner, two different sized and/or shaped containers can be transported using the same type of collar.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A transportation collar, comprising:

a ring having a central longitudinal axis and including:

a base wall extending transversely and radially inwardly with respect to the axis, and an annular skirt extending in a first axial direction axially away from the base wall; and a peripheral impact barrier extending radially outwardly from the ring adapted to position both the transportation collar and a container carried by the collar relative to one or more additional adjacent transportation collars and one or more additional corresponding containers, wherein the peripheral impact barrier comprises a flange wall extending transversely with respect to the axis and radially outwardly of the base wall and the annular skirt and having a radially outer periphery that is non-circular with respect to the central longitudinal axis.

2. The collar of claim 1, wherein the base wall further comprises:

a resilient first planar portion extending radially inwardly with respect to the axis; and a stepped portion extending radially inwardly from the planar portion and extending at least partially in the first axial direction.

3. The collar of claim 2, wherein the stepped portion includes a second planar portion which is parallel to the planar portion and a connecting portion which adjoins the first and second planar portions.

4. The collar of claim 1, wherein the base wall further comprises a second annular skirt extending in a second, opposite axial direction away from the base wall.

5. The collar of claim 4, wherein each of the first and second annular skirts comprise a retaining bead that extends radially inwardly with respect to the axis.

6. The collar of claim 4, wherein, with respect to the axis, the first annular skirt is positioned radially inboard relative to the second annular skirt.

7. The collar of claim 1, wherein the peripheral impact barrier comprises a first skirt extending in the first axial direction and a second skirt extending in a second, opposite axial direction.

8. The collar of claim 1, wherein the peripheral impact barrier comprises a rectangular outer periphery and the ring is located within the periphery.

9. The collar of claim 1, wherein the peripheral impact barrier comprises at least one pull tab configured to facilitate removal of the transportation collar from the corresponding container.

10. The collar of claim 1, wherein the peripheral impact barrier comprises two or more interlocking pieces which retain the corresponding container in an interlocked state and release the corresponding container in a disconnected state.

11. A transportation collar, comprising;

a ring having a central longitudinal axis and including:

a base wall extending transversely and radially inwardly with respect to the axis, an annular skirt extending in a first axial direction axially away from the base wall, and a diametrically extending handle; and a peripheral impact barrier extending radially outwardly from the ring adapted to position both the transportation collar and a container carrier by the collar relative to one or more additional adjacent transportation collars and one or more additional corresponding containers, wherein the peripheral impact barrier comprises a flange wall extending transversely with respect to the axis.

12. A transportation collar, comprising:

a ring having a central longitudinal axis and including:

a base wall extending transversely with respect to the axis, comprising:

a planar portion extending radially inwardly with respect to the axis, and a stepped portion extending radially inwardly from the planar portion and extending at least partially in a first axial direction;

a first annular skirt extending in the first axial direction axially away from the base wall, and a second annular skirt extending in a second, opposite axial direction away from the base wall; and a peripheral impact barrier extending radially outwardly from the ring such that the peripheral impact barrier extends radially outwardly of the base wall and the first and second annular skirt and having a radially outer periphery that is non-circular with respect to the central longitudinal axis.

13. The collar of claim 12, wherein the stepped portion includes a second planar portion which is parallel to the planar portion and a connecting portion which adjoins the first and second planar portions.

14. The collar of claim 12, wherein the peripheral impact barrier comprises a first skirt extending in the first axial direction and a second skirt extending in a second, opposite axial direction.

15. The collar of claim 12, wherein the peripheral impact barrier comprises at least one of:

at least one pull tab configured to facilitate removal of the transportation collar from a corresponding container when the collar is coupled to the container, or two or more interlocking pieces adapted to retain a corresponding container when the pieces are in an interlocked state and adapted to release the corresponding container when the pieces are in a disconnected state.

16. A transportation collar, comprising:

a ring having a central longitudinal axis and including:

a base wall extending transversely with respect to the axis, comprising:

a planar portion extending radially inwardly with respect to the axis, and a stepped portion extending radially inwardly from the planar portion and extending at least partially in a first axial direction;

a first annular skirt extending in the first axial direction axially away from the base wall, a second annular skirt extending in a second, opposite axial direction away from the base wall, and a diametrically extending handle; and a peripheral impact barrier extending radially outwardly from the ring.

17. A transportation collar, comprising:

a ring having a central longitudinal axis and including a base wall extending transversely with respect to the axis and including a planar portion and a stepped portion extending radially inwardly from the planar portion and in a first axial direction axially away from the base wall, a first annular skirt extending in the first axial direction axially away from the base wall, including a first radially inwardly extending bead, and having a first inner diameter, and a second annular skirt extending in a second direction axially away from the base wall, including a second radially inwardly extending bead, and having a second inner diameter larger than the first inner diameter of the first annular skirt;

a first side with a first contour corresponding to a first package type and at least partially established by a first side of the stepped portion of the base wall and the first annular skirt; and a second side with a second contour corresponding to a second package type and at least partially established by a second side of the stepped portion of the base wall and the second annular skirt.

* * * * *